US005403156A

United States Patent [19]

Arness et al.

[11] Patent Number: 5,403,156

[45] Date of Patent: Apr. 4, 1995

[54] INTEGRAL METER PLATE FOR TURBINE BLADE AND METHOD

[75] Inventors: Brian P. Arness, Palm Beach Gardens; Wesley D. Brown, Jupiter, both of Fla.

[73] Assignee: United Technologies Corporation, Hartford, Conn.

[21] Appl. No.: 143,681

[22] Filed: Oct. 26, 1993

[51] Int. Cl.[6] ..... F01D 5/18

[52] U.S. Cl. ..... 416/96 R; 29/889.21; 29/889.721; 416/87 R

[58] Field of Search ..... 415/115, 116, 118, 1; 416/95, 96 R:96 A, 97 R, 61, 1; 29/889.21, 889.721, 889.7

[56] References Cited

U.S. PATENT DOCUMENTS

| | | | |
|---|---|---|---|
| 2,603,453 | 7/1952 | Sollinger | 416/95 |
| 3,318,573 | 5/1967 | Matsuki et al. | 416/95 |
| 3,706,508 | 12/1972 | Moskowitz et al. | 415/115 |
| 3,791,758 | 2/1974 | Jenkinson | 415/116 |
| 4,010,531 | 3/1977 | Andersen et al. | 29/889.721 |
| 4,626,169 | 12/1986 | Hsing et al. | 416/45 |
| 4,820,123 | 4/1989 | Hall | 416/97 R |
| 4,822,244 | 4/1989 | Maier et al. | 415/115 |
| 5,293,759 | 9/1993 | Brown et al. | 29/889.721 |

FOREIGN PATENT DOCUMENTS

| | | | |
|---|---|---|---|
| 0314606 | 5/1989 | European Pat. Off. | 416/95 |

*Primary Examiner*—Edward K. Look
*Assistant Examiner*—Christopher Verdier
*Attorney, Agent, or Firm*—Norman Friedland

[57] ABSTRACT

A meter plate formed from a depending member extending from the root of a turbine blade just short of the edge of the bottom of the broach in the disk in the live rim area is cast integrally with the blade and serves to meter coolant flow from the on board injector to internally of the blade. The final dimension can be configured in the machining operation of the blade to attain the desired amount of coolant flow for internal blade cooling.

6 Claims, 3 Drawing Sheets

INTEGRAL METER PLATE FOR TURBINE BLADE AND METHOD

This invention was made under a U.S. Government contract and the Government has rights herein.

TECHNICAL FIELD

This invention relates to turbine blades for gas turbine engines and particularly to means for metering cooling air to internally cool the turbine blades.

BACKGROUND ART

As is well known in the gas turbine engine technology, the cooling of the turbine blades, particularly, the first stage turbine, is extremely important not only to preserve the integrity of the blade structure but to also attain high engine performance by operating the turbine at optimum temperature levels. It is abundantly important in this environment to maximize the use of cooling air to avoid utilizing more air than is necessary so as to lessen the overall penalty that is attendant the use of engine air for purposes other than generating thrust or horsepower. Inasmuch as the gas turbine engine operates at higher efficiencies by operating the first stage turbine at higher temperatures and the trend for future engines is to increase turbine inlet temperatures so as enhance engine efficiency and thereby reduce fuel consumption, the engine designer is faced with the problem of increasing turbine inlet temperature while at the same time attempting to reduce the amount of cooling air or at the very least to optimize its use.

As is well known, one method of optimizing the use of cooling air is to employ metering devices to restrict the flow entering into the roots of each of the blades. Typically, these flow restrictive or metering devices are comprised of an extra sheet metal component that is welded or brazed to the bottom of the blade. An example of a metering device that is bolted to the root of a stator blade is exemplified in U.S. Pat. No. 3,706,508 granted to Moskowitz, et al on Dec. 19, 1972 and entitled "Transpiration Cooled Turbine Blade with Metered Coolant Flow".

United Kingdom Patent Application No. 2 225 063 A published for Ulrich Radons on May 23, 1990 entitled "Turbine Cooling Arrangement" discloses an insert that is bonded to the blade base for flowing coolant into the rotor blades. Other patents that, while not necessarily teach metering means, but relate to means for feeding coolant to the turbine rotor blades are U.S. Pat. No. 4,767,261 granted to Godfrey et al on Feb. 12, 1974 entitled "Cooled Vane" that utilizes a baffle plate internally of the vane; U.S. Pat. No. 3,791,758 granted to Jenkinson on Feb. 12, 1974 entitled "Cooling of Turbine Blades" that include divergent walls for defining a diffuser for leading coolant to the root of the blades; and U.S. Pat. No. 4,626,169 granted to Hsing et al on Dec. 2, 1986 entitled "Seal Means for a Blade Attachment Slot of a Rotor Assembly" that provides a baffle that leads coolant to the rotor blades.

We have found that we can attain a more efficient use of cooling air and eliminate the extra component parts that were heretofore necessary for metering coolant with a consequential improvement in the castibility of the blade, ease of fabrication and assembly by eliminating the brazing or welding operation, and eliminate the need to inventory the component parts. While this results in lowering costs, it does have the disadvantage of slightly increasing weight.

However, there is a distinct advantage when utilizing this invention in cast film cooled, high efficiency turbine blade designs. The pressure of the tangential onboard injectors (known as TOBI) that serves to transmit the cooling air in the rotating machinery to the roots of the turbine blades is determined on the blade's outflow requirements and airfoil root leading edge stagnation pressure. This, typically, provides higher than required pressure air to the remaining portion of the blade. Therefore, to maintain acceptable flow levels for main body film cooling and trailing edge flow restricting features,(for example, crossover and film holes) these holes must be sized relatively small. By decreasing this pressure in these areas by use of the metering valve, these flow restricting features can be enlarged without increasing flow. The advantage of being able to increase the size of the holes enhances the castability of the blade and the film effectiveness.

In actual tests of blades employing this invention, the inventive meter plate increased the size of the trailing edge crossover holes to approximately 30% larger than heretofore known designs. In addition, the design made it possible to add additional film cooling holes. In this configuration that was tested 3 extra film cooling holes were added in each of the rows of film cooling holes.

SUMMARY OF THE INVENTION

An object of this invention is to provide improved cooling means for the rotor blades of a gas turbine engine.

A feature of this invention is to provide an integrally cast metering plate extending from the root of the blade toward the live rim of the disk of the blade to define therewith a metering plate.

Another object of this invention is to provide a method of "tailoring" the amount of cooling air metered by the metering plate of this invention.

This invention utilizes a cast metering plate that is characterized as being less costly than other metering plates, facilitates the assembly and disassembly of blade assemblies, and enhances cooling effectiveness.

The foregoing and other features of the present invention will become more apparent from the following description and accompanying drawings.

DETAILED DESCRIPTION OF THE PREFERRED EMBODIMENT

While this invention is described herein in its preferred embodiment as being utilized on the first stage turbine of a gas turbine engine, as one skilled in this art will appreciate, this invention may be employed in other rotors. However, this invention is a combination of a meter plate and turbine blade defining with the live rim area of the disk the metering area, where the meter plate is cast integrally with the casting of the blade.

Figure 1:
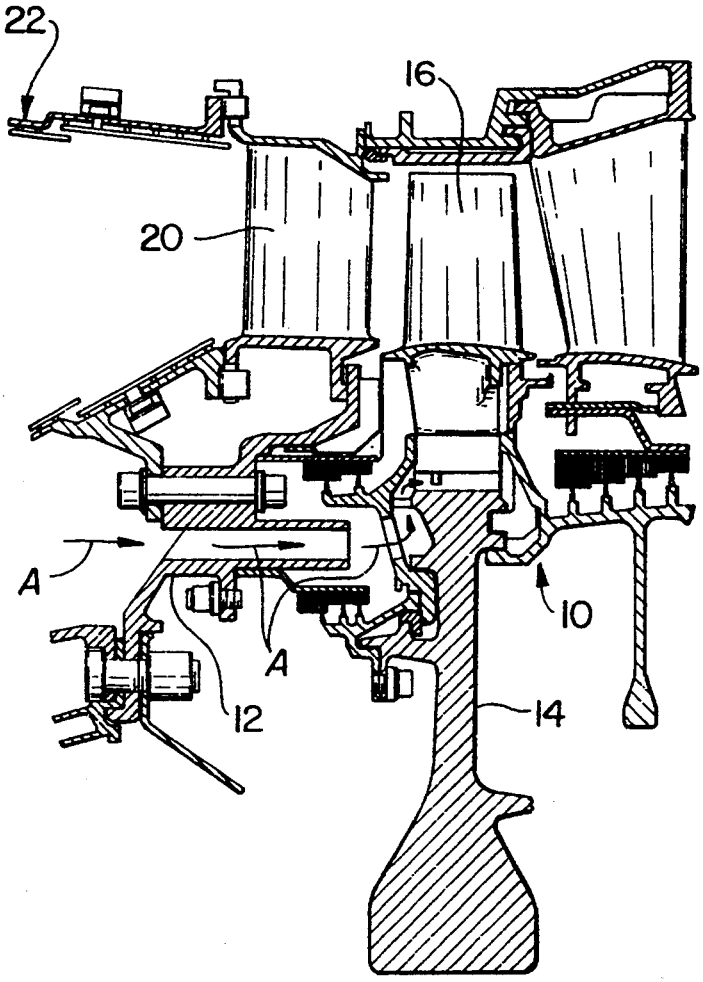
FIG. 1 is a partial sectional view of the turbine section of a gas turbine engine utilizing this invention.

The invention can best be appreciated by referring to FIG. 1 which discloses the use of this invention in the first stage turbine section of a gas turbine engine (only partially shown). Inasmuch as the details of the engine are not necessary for an understanding of this invention, for the sake of convenience and simplicity only that portion of the engine necessary to describe this invention will be described. For more details of a gas turbine engine reference should be made to U.S. Pat. No. 4,069,662 granted to Redinger, Jr., et al on Jan. 24, 1978 entitled "Clearance Control for Gas Turbine Engine" or any of a number of engine models such as the F100, JT9D, PW2000 and PW4000, manufactured by the Pratt & Whitney Division of United Technologies Corporation, the assignee common to this patent application.

Suffice it to say, that a portion of the air is bled from the compressor section (not shown) and is ultimately delivered to the turbine rotor generally indicated by reference numeral 10 through the TOBI 12 as depicted by arrows A.

The rotor comprises disk 14 suitably supporting a plurality of circumferentially spaced turbine blades 16. The root 18 of each of the blades are attached to a recess or broach formed in the outer periphery or live rim area of the disk 14. In this design the broach is formed in a fir tree configuration which is a well known configuration for supporting the blades to the disk.

Rotor 10 is rotatably supported to the engine shaft and is disposed adjacent the first stator section 20 that is supported to the combustor generally indicated by reference numeral 22. As is well known, combustion air discharging from combustor 22 flows through the vanes of stator section 20 through blades 16, where work is extracted to power the compressor. As is apparent from the foregoing, the combustion gases that flow through the turbine blades are exceedingly hot necessitating cooling of the turbine rotor.

Figure 2:
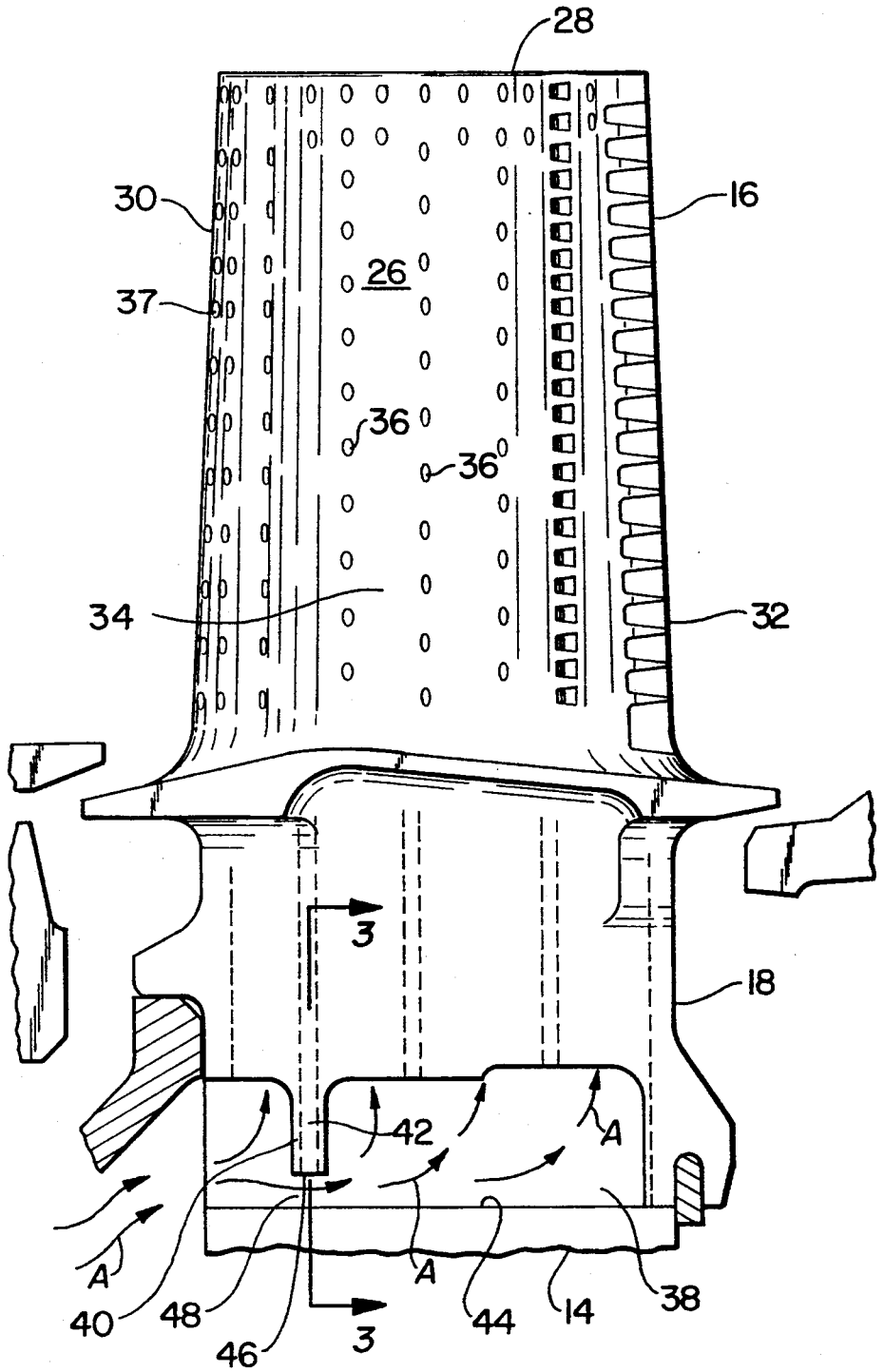
FIG. 2 is an enlarged view of a turbine blade in elevation showing the details of this invention.

As shown in FIG. 2, blade 16 consists of a root 18, an airfoil section 26 having a tip section 28, leading edge 30 trailing edge 32 and a pressure side 34 and suction side (not shown) on the back of the pressure surface extending therebetween. Coolant is admitted into the live rim area 38 at the outer periphery of the disk and the root 18 and flows internally in the blade in a suitable manner and discharges therefrom through a plurality of film cooling holes 36 or shower head holes 37. As the detail of the cooling aspects of the blade is well known and described for example in U.S. Pat. No. 4,820,123 granted to Kenneth B. Hall on Apr. 11, 1989 for more details of a suitable turbine blade reference should be made to this patent which is incorporated herein by reference.

Figure 3:
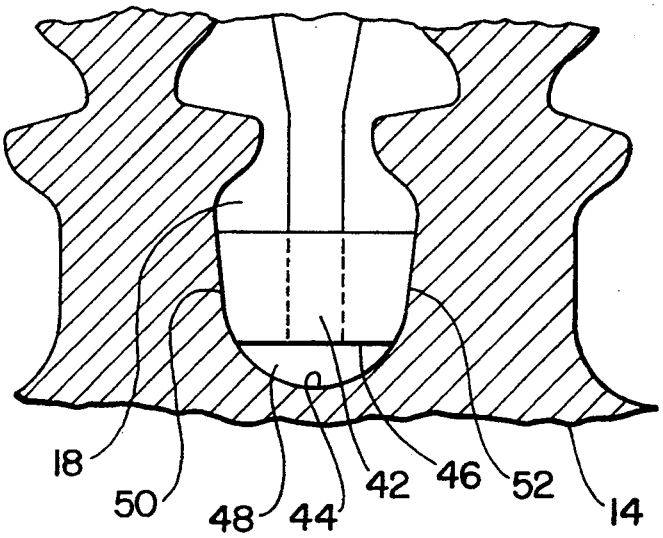
FIG. 3 is a partial sectional view taken along lines 3—3 of FIG. 2.

In accordance with this invention and best shown in FIGS. 2 and 3, the meter plate generally indicated by reference numeral 40 consists of a depending member 42 integrally cast in the root 18 of blade 26 and extends in the live rim area 38 toward the upper surface 44 of disk 14. The bottom edge 46 extends just short of surface 44 and defines therewith the metering area 48. As noted in FIG. 3, the cast metering plate depending member 42 extends between walls 50 and 52 defining the broach formed in disk 14.

It is apparent from the foregoing that the dimensions of the depending member 42 can be finalized after member 42 is cast. In this way, member 42 is cast oversized and is machined to the desired dimension in the finish machining of the blade. This will assure that the metering dimension is zeroed in to the desired area for achieving the desired pressure and flow of coolant for each blade. By being able to tailor the dimensions as described it is apparent that only the necessary amount of coolant needed to perform the desired cooling is utilized. Hence, each blade can be likewise tailored to assure that unnecessary coolant is not inadvertently used.

The method of adjusting the metering plate to meter the desired amount of cooling air to the internal passages of the turbine blade is to assemble the blade with the oversized projection and flow test the assembly. Remove the blade and machine the oversized projection to obtain the desired metering area to meter the intended amount of cooling air. This is repeated until the correct amount is "zeroed in".

Another advantage of this integral design of the cast meter plate is that it does not add to the expense of casting the overall blade. Hence, not only is the invention inexpensive, it obviates all the problems associated with heretofore meter plates that are not integral with the blade.

Although this invention has been shown and described with respect to detailed embodiments thereof, it will be appreciated and understood by those skilled in the art that various changes in form and detail thereof may be made without departing from the spirit and scope of the claimed invention.

We claim:

1. In combination, an internally air cooled turbine blade having a root section at one end and a turbine rotor disk for a gas turbine engine, said blade being cast including a projection extending axially from said root section and supported in a recess formed in the outer periphery of said rotor disk, means for conducting cooling air into internal passages formed in said turbine blade through said recess, said projection extending in said disk to define therewith a metering plate to regulate the flow of cooling air from said recess into said passages, the length of said projection being modifiable so as to be predetermined, in situ, to select the amount of metering by said metering plate.

2. The combination as claimed in claim 1 wherein said disk includes a pair of opposing side walls and a bottom wall defining said recess, said projection extending short of said bottom wall and to the pair of side walls.

3. The combination as claimed in claim 2 wherein said recess is formed in a fir tree configuration.

4. The combination as claimed in claim 2 wherein said means for conducting cooling air includes a tangential onboard injector for conducting said cooling air to said recess.

5. The combination as claimed in claim 4 including a plurality of air cooled turbine blades each having a root section and cast with an axial projection extending therefrom and supported in recesses formed in the outer periphery of said disk and being circumferentially spaced, between each of said recesses having opposing side walls and a bottom wall, said projection of each of said air cooled turbine blades extending in each of said recesses spaced from the bottom wall of each of said recesses, and the width of said projection of each of said blades being coextensive with the width of the opposing side walls of each of said recesses, and defining therewith enclosed chambers for receiving said cooling air, and said each of said projections together with said bottom wall of said disk defining metering plates for metering the flow in each of said chamber, to said passages in each of said air cooled turbine blades.

6. The method of controlling flow of cooling air to an air cooled turbine blade which has internal passages and being mounted on a turbine rotor disk for a gas turbine engine including the steps of:

casting the turbine blade with internal cooling passages and with an enlarged projection dimensioned for fitting into a recess of the turbine rotor disk for defining a metering plate, assembling the blade obtained in the step of casting into the recess of said turbine rotor disk, measuring the flow of air by flowing air into said recess to flow through the metering opening of said metering plate and the internal passages of the blade, disassembling said blade from said recess and machining said projection to adjust said metering plate and repeating the steps of measuring and disassembling until the flow meets a desired amount of air into the internal passages of said turbine blade.

* * * * *